United States Patent [19]

Gross et al.

[11] Patent Number: 4,628,324

[45] Date of Patent: Dec. 9, 1986

[54] COIL ASSEMBLY FOR SUBSTANTIALLY ISOTROPIC FLUX LINKAGE IN A GIVEN PLANE

[75] Inventors: Thomas A. O. Gross, Lincoln, Mass.; Raymond L. Barrett, Jr., Oakland Park; Henry F. Pfister, Wilton Manors, both of Fla.

[73] Assignee: Sensormatic Electronics Corporation, Boca Raton, Fla.

[21] Appl. No.: 782,738

[22] Filed: Oct. 1, 1985

Related U.S. Application Data

[63] Continuation of Ser. No. 368,370, Apr. 14, 1982, Pat. No. 4,549,186.

[51] Int. Cl.[4] ..... H01Q 7/00

[52] U.S. Cl. ..... 343/788

[58] Field of Search ..... 343/787, 788, 741–744, 343/748; 340/572

[56] References Cited

U.S. PATENT DOCUMENTS 2,870,442 1/1959 Polydoroff ..... 343/788

2,953,785 9/1960 Granquist ..... 343/788

*Primary Examiner*—Eli Lieberman

*Attorney, Agent, or Firm*—Robin, Blecker & Daley

[57] ABSTRACT

A coil assembly that is essentially isotropic in a plane normal to the plane of the coil includes two flat coils stacked one next to the other. One coil is connected in series with a resistor in a closed loop and has a strip of high permeability material woven through it. The other coil is tuned by a parallel capacitor across its coil terminals, such terminals being connected to electronic circuitry. The coil is separated from the printed circuit board that contains the electronic circuitry by a sheet of high permeability material. The assembly is self-contained and powered by a flat battery on which the circuit board is placed. Another embodiment is disclosed that contains only one coil, the terminals of which are connected to a suitable electronic circuit, not shown. Strips of high permeability material are disposed on both sides of the coil and an assembly is produced with a printed circuit board and a flat battery.

9 Claims, 6 Drawing Figures

COIL ASSEMBLY FOR SUBSTANTIALLY ISOTROPIC FLUX LINKAGE IN A GIVEN PLANE

This application is a continuation of application Ser. No. 368,370 filed Apr. 14, 1982, now U.S. Pat. No. 4,549,186.

BACKGROUND OF THE INVENTION

The present invention relates to a coil assembly for use in a communication system. More particularly it relates to a coil assembly for use in a communication system in which the spacial orientation of the coil assembly relative to other components in the system can not be predetermined.

There exist numerous communication systems in which communication is to be established between two or more components by means of a linking magnetic field and in which at least one of the components is movable relative to another such that isotropic sensitivity is important at least in a given plane for maintaining communication. The need for isotropic response in paging systems and article surveillance systems, to name two examples, should be readily apparent.

Assuming that communication is to be established either to or from a loop coil by means of an AC magnetic field, the problem exists of ensuring adequate magnetic coupling between the coil and the field regardless of the spacial orientation of the coil relative to the lines of flux constituting the field. It is well known, for example, that a flat coil immersed in a magnetic field, wherein all of the lines of flux are parallel to the plane of the coil, will experience little or no magnetic coupling with such field. On the other hand, if the coil is used to produce the field, the lines of flux will be radiated normal to the general plane of the coil and little or no signal will radiate parallel to the coil plane. The action of such coil is clearly anisotropic and null conditions will exist in any communication system in which the relative spacial orientation of the coil can not be predetermined In the copending application of Raymond L. Barrett, Jr., entitled "Randomized Tag To Portal Communication System" filed on Mar. 5, 1982, accorded Ser. No. 354,156 now Pat. No. 4,471,345, and assigned to the same assignee as the present application, there is disclosed a system in which a doorway is provided with a loop coil for establishing an AC magnetic field that is intended to couple with a smaller loop coil carried by a personnel identification tag or marker. In particular, said application describes by way of an example a system for tracking the location of doctors within a hospital facility. It should be appreciated that in any system involving the use of a tag carried by an individual a general constraint may be imposed such that the tag is always carried in a vertical or near vertical orientation. Because of such constraint, the requirement for isotropic tag response to the interrogating field is important only with respect to a plane that is normal to the general plane of the tag.

It is, therefore, an object gf:the present invention to provide a flat coil that can be used in an identification tag or the like that will have a substantially isotropic response to an interrogating AC magnetic field at least in a plane normal to the general plane of the coil.

SUMMARY OF THE INVENTION

In accordance with the present invention there is provided a coil assembly for use in a communication system in which coupling between said assembly and another communication component is to be established by linking said assembly and said component with an AC magnetic field, said assembly comprising a coil in the form of a loop of pancake configuration formed from electrically conductive turns encircling a first axis that is normal to the general plane of said coil, and means including magnetically permeable material cooperatively disposed adjacent said conductive turns and interrelated therewith for providing substantially isotropic flux linkage between said conductive turns and said magnetic field in a plane that is normal to said general plane.

BRIEF DESCRIPTION OF THE DRAWINGS

The invention will be better understood after reading the following detailed description of the presently preferred embodiments thereof with reference to the appended drawings in which.

DETAILED DESCRIPTION OF THE PREFERRED EMBODIMENTS

Figure 1:
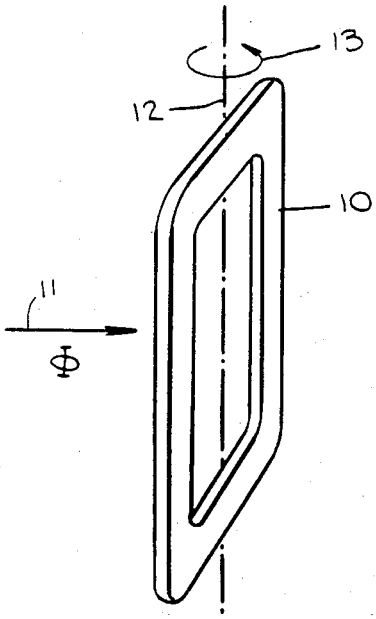
FIG. 1 is a schematic illustration of a flat pancake coil immersed in a magnetic field.

The same reference numerals are used throughout the drawings to designate the same or similar parts.

Referring to FIG. 1, there is represented schematically therein a flat pancake type coil 10 of simple rectangular configuration. The rectangular configuration has been chosen in this example because conforms conveniently to the shape normally utilized in the fabrication of identification badges or the like. It should be understood, however, that the underlying principles, implicit in the examples of the subject invention contained herein, are applicable to other coil shapes and to other communication components.

Assume that the coil 10 is immersed in an AC magnetic field whose flux $\phi$ is directed in the direction of the arrow 11 perpendicular to the long axis 12 of the coil 10. Upon rotation of the coil 10 about its long axis 12 in the direction of arrow 13, following well known principles, a voltage will be induced in the coil when its plane is normal to the flux 11 while a deep null in said voltage will appear when the coil is rotated 90° such that the flux 11 is traveling parallel to the plane of the coil. If a simple coil such as represented in FIG. 1 is incorporated in a tag used for identification of personnel, some reasonable assurance exists that the coil will be oriented in a verticle plane. By suitably constructing the tag and locating its fastening clip or suspension point, it is also possible to arrange for the coil to be oriented with its long axis in a particular direction, e.g., vertical. However, little or no control can be exercised over the relative angular orientation about long axis 12 of the coil 10 as it is carried past a portal or interrogation position. Nevertheless, it is important for reliable tracking that the tag be capable of effective coupling to the portal position regardless of its orientation about axis 12. This can be assured only if there can be obtained substantially isotropic flux linkage between the coil 10 and the magnetic field in a plane that is normal to the general plane of the coil 10, and, in this instance, normal to the axis 12.

Figure 3:
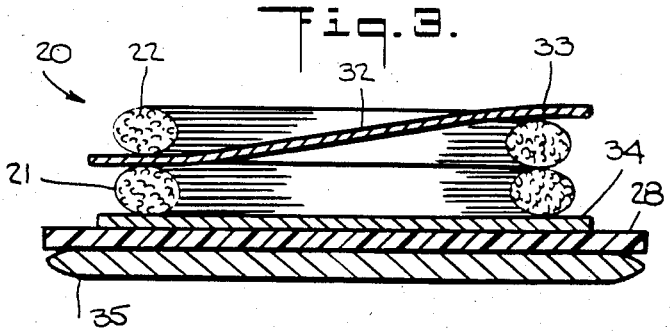
FIG. 3 is a transverse sectional veiw taken along line 3–3 in FIG. 2.
Figure 2:
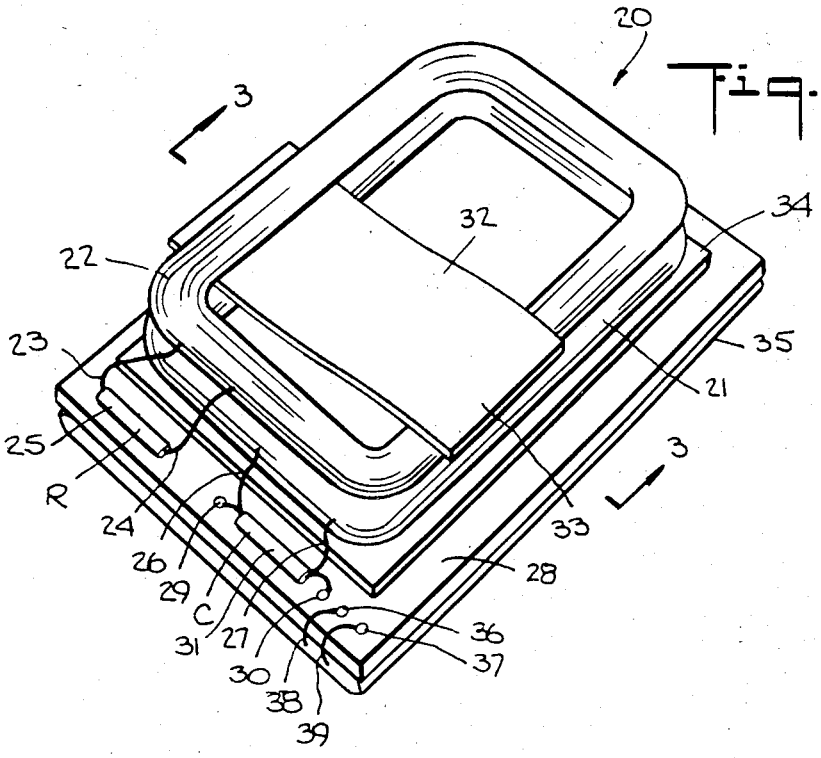
FIG. 2 is a perspective view of a coil assembly constructed in accordance with the present invention.

Referring now to FIGS. 2 and 3 there is shown a complete tag structure including a coil assembly that exhibits the required isotropic response in a plane as mentioned above. The tag structure is designated generally by the reference numeral 20, and consists of first and second coils 21 and 22 each in the form of a loop of pancake configuration formed from electrically conductive turns of insulated wire encircling a respective axis that is normal to the general plane of the respective coil. As shown, the two coils 21 and 22 are substantially congruent and disposed in registration, one upon the other in such close proximity that transformer coupling unites the two coils electrically.

The coil 22 is provided with terminal leads 23 and 24 by which it is connected in series with a resistor 25 in a closed loop. Thus, any magnetic flux linkage with the coil 22 will induce a flow of circulating current.in such coil that by transformer action will induce a voltage in the coil 21.

The coil 21 is provided with terminal leads 26 and 27 for connection to an electronic circuit (not shown) which, in this example, is located on a printed circuit board 28. Connection to the circuit is effected through terminals 29 and 30. A capacitor 31 is connected across terminal leads 26 and 27 for tuning coil 21 in the manner to be described.

A thin strip 32 of magnetically permeable material is disposed relative to coil 22 extending across its width under one side of the coil 22 between it and coil 21, through the coil 22, and over the other side at 33. The function of strip 32 is to provide a low reluctance flux path through coil 22 that is particularly effective for diverting flux, normally parallel to the plane of coil 22, through coil 22 into linking relationship.

For a purpose that will also be discussed below, a sheet 34 of magnetically permeable material preferably as large as the coil 21 is disposed parallel to coil 21 adjacent thereto on the side remote from coil 22. Immediately adjacent the sheet 34 is the circuit board 28 containing the electronic circuit (not shown) to which the coil 21 is connected. Finally, the circuit board 28 contacts a flat battery 35 of comparable size. As shown, the circuit on board 28 is brought out to terminals 36 and 37 that are connected by leads 38 and 39 to battery 35.

The battery 35, having conductive metal components in which eddy currents can be induced will tend to modify the effective flux linkage between coil 21 and any AC magnetic field in which it is immersed. Generally, in the absence of permeable sheet 34 the voltage induced in coil 21 when it is positioned normal to the flux lines will be greater in the absence of battery 35 and is diminished by the presence of the battery. However, permeable sheet 34 provides a lateral path for flux entering the center of coil 21 and carries said flux toward the margins of battery 35 thereby at least partially overcoming the response degradation that would otherwise occur.

Figure 4:
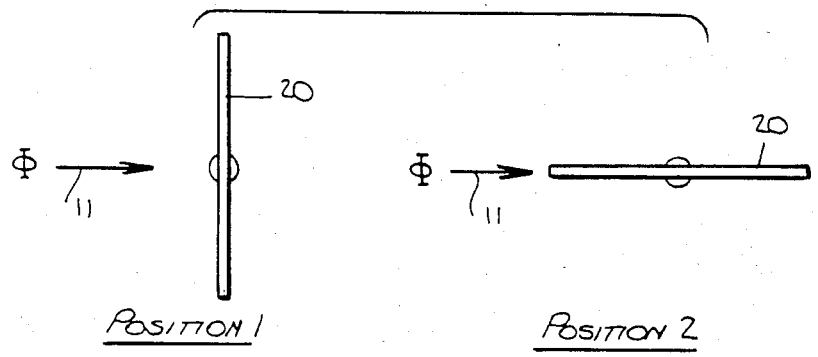
FIG. 4 is a schematic diagram showing various orientations of the coil assembly of FIG. 2 in a magnetic field that are utilized during the manufacturing adjustment of the assembly.

The coil assembly is intended to operate in an AC magnetic field. Test models have been produced and tuned for operation at 25 KHz although that frequency can be varied depending upon the overall system requirements. It is mentioned here only by way of example. During fabrication of the coil assembly the appropriate values for resistor 25 and capacitor 31 can best be determined empirically. Referring to FIG. 4, the coil assembly is first placed in position "1" in a substantially collimated and uniform AC magnetic field. Coil 21 is then tuned by a variable capacitor, in the place of capacitor 31, until a maximum voltage appears at a meter (not shown) across terminals 26 and 27. This should be the resonant condition. The signal strength at such setting should be noted. Next, the assembly should be rotated 90° to position "2" whereupon an adjustable resistance, in place of resistor 25, is adjusted until the signal strength read on a meter across terminals 23 and 24 is about one half that noted in the preceding step. Next, the assembly is returned to position "1" and the capacitor readjusted for maximum reading on the meter across its terminals. Then position "2" is again assumed and the resistor is readjusted. The foregoing alternate adjustments are continued until equal response is obtained from each of coils 21 and 22 at a maximum level. The values of the adjustable resistor and capacitor are noted and these can now be replaced by fixed value components. With appropriate control over the construction of the coils 21 and 22 it is possible to keep their parameters from unit to unit within sufficiently close limits that once the values of resistance and capacitance are determined such values can continue to be used until the coil construction is changed.

As mentioned previously, a coil assembly as described with reference to FIGS. 2 and 3 has been constructed and tested with the result that the signal strength appearing across capacitor 31 was found to be extremely uniform with no observable dip as the coil was rotated about its vertical long axis 12 through 360°. That is, for a plane normal to the plane of the windings the assembly is substantially isotropic.

For the particular example here presented, the magnetically permeable elements 32 and 34 may be formed from permalloy or silicon steel or the like and have a thickness of from 1 to 4 mils. Thicker strips could be used but consideration will have to be given to the increased spacing brought about between coils 21 and 22 and the decoupling thereby resulting as well as the cost. The battery 35 can be of any convenient construction. One such battery in the primary category that is commercially available is packaged in a flat foil-like enclosure. It is obtainable from the Polaroid Corporation under their "POLAPULSE" trademark.

Figure 5:
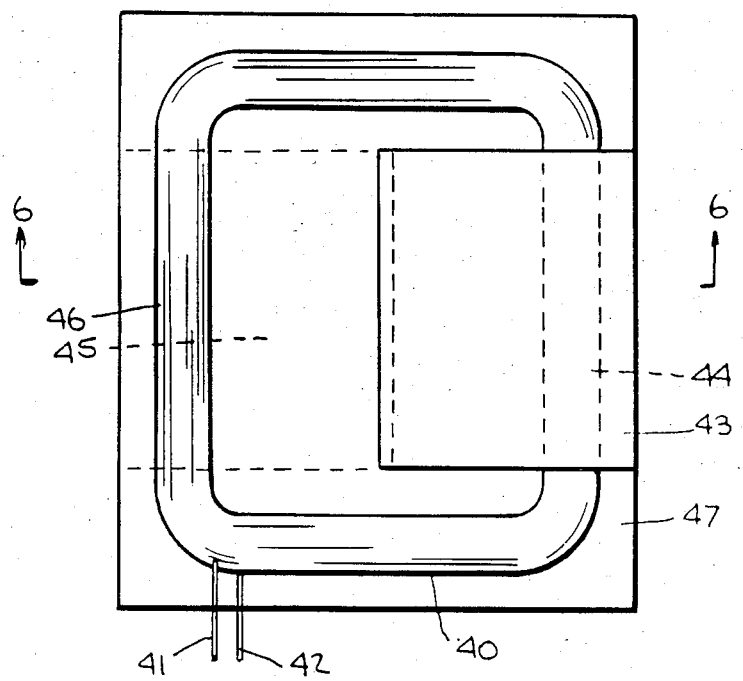
FIG. 5 is a top plan view of another embodiment of the coil assembly.
Figure 6:
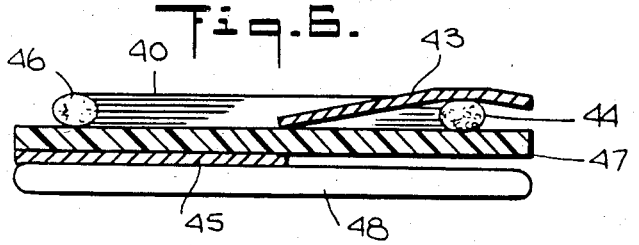
FIG. 6 is a transverse sectional view taken along line 6—6 in FIG. 5.

Turning now to FIGS. 5 and 6, there is shown therein another embodiment of the present invention demonstrating less anisotropy in a plane normal to the plane of the coil assembly, although not quite as isotropic as the embodiment described with reference to FIGS. 2 and 3. In the embodiment of FIGS. 5 and 6 a single coil 40 is provided of wire-wound construction and with terminals 41 and 42. Onc strip of magnetically permeable material, 43, is disposed above the coil 40, as viewed in FIG. 6, extending inwardly from a point located beyond the radially outermost perimeter of pancake coil 40 toward the axis of said coil generally parallel to the plane of said coil and across the turns of the adjacent section 44 of the coil. Another strip 45 of magnetically permeable material is disposed overlying another section of the coil turns at 46 on the opposite side in the axial direction of said pancake coil from the first strip 43. See FIGS. 5 and 6.

A layer of insulating material 47 substantially coextensive with the coil 40 is disposed between coil 40 and one of the permeable strips, namely, the strip 45. A battery 48, similar to the battery 35, of generally flat construction with a surface area substantially greater than either of the strips 43 or 45 is disposed adjacent the strip 45, i.e., the strip that is separated from coil 40 by the insulating layer 47, and generally parallel to both the insulating layer 47 and the coil 40. As shown in the drawings, the strips 43 and 45 are generally in line with a slight overlap as viewed in the axial direction of the coil 40. See FIG. 5.

While not shown in FIG. 5, the insulating layer 47 may be a printed circuit board containing a circuit thereon electrically interconnected with coil 40 via terminals 41 and 42 in a manner similar to that described and shown in FIGS. 2 and 3.

When the coil 40 is placed in a magnetic field, flux in a direction normal to the general plane of coil 40 will link with the coil in the usual manner with the permeable strips having negligible effect. However, the presence of battery 48 will result in some attenuation of the signal developed by coil 40 for this orientation for the reason discussed previously.

If coil 40 is oriented with its plane parallel to the magnetic flux lines, the following situation arises. When the coil assembly is oriented in the position shown in FIG. 5 and with the flux lines oriented, horizontally as viewed in the drawing, such flux will "see" a lower reluctance path via strips 43 and 45 through the plane of coil 40 then that through the surrounding air. Hence, effective flux linkage that normally would not occur is now obtained. If the coil is now rotated in the field about a vertical axis as viewed in FIG. 5, that is, about an axis normal to the paper as viewed in FIG. 6, slight dips in response will be observed. Nevertheless, this embodiment is reasonably isotropic for the relationship just discussed.

Permeable strips of various samples of permalloy as well as of silicon steel have been used successfully in fabricating coil assemblies with improved isotropy as described herein. Theoretically, any material having a greater permeance than air can be used to some advantage. Because the higher permeablity materials are more efficient, the final selection will be influenced by considerations of cost, size and weight.

Having described the presently preferred embodiments of the subject invention it should be apparent to those skilled in the subject art that numerous changes in construction can be adopted without departing from the true spirit of the invention as defined in the appended claims.

What is claimed is:

1. A coil assembly for use in an article surveillance system in which coupling between said assembly and another component is to be established by linking said assembly and said component with an alternating magnetic field, said assembly comprising a coil in the form of a loop of flat configuration formed with electrically conductive turns encircling a first axis that is normal to the general plane of said coil, and means including magnetically permeable material in strip form throughout and extending inwardly across the interior of said coil from a first location beyond the perimeter of said coil inwardly through said coil interior to a second location also beyond the perimeter of said coil for providing a continuous low reluctant path through said coil which diverts flux of said field parallel to said general plane of said coil through said coil, such magnetically permeable material being movable in unison with said coil and having negligible effect upon linkage of said coil with flux in a direction normal to said general plane of said coil.

2. The coil assembly claimed in claim 1 wherein said means comprises a first strip of magnetically permeable material having one end at said first location and a second end inwardly of said coil and a second strip of magnetically permeable material having one end at said second location and a second end inwardly of said coil.

3. The coil assembly claimed in claim 2 wherein said second ends of said first and second strips overlap one another.

4. The coil assembly claimed in claim 3 further including an electrically insulative member disposed between said first and second strips.

5. The coil assembly claimed in claim 2 wherein said first and second strips are aligned with one another.

6. The coil assembly claimed in claim 4 wherein said first and second strips are aligned with one another.

7. The coil assembly claimed in claim 1 wherein said means comprises a single strips of magnetically permeable material having one end at said first location and a second end at said second location.

8. The coil assembly in claim 1 wherein such magnetically permeable sheet material is elongate has no length thereof disposed along or in parallel with said first axis.

9. The coil assembly in claim 1 wherein said coil is in the form of a loop of flat rectangular configuration and wherein such magnetically permeable sheet material is of flat rectangular configuration.

* * * * *